United States Patent [19]

Poulsen

[11] Patent Number: 4,556,091

[45] Date of Patent: Dec. 3, 1985

[54] METHOD AND APPARATUS FOR COOLING SELECTED WALL PORTIONS OF A PRESSURIZED GAS CYLINDER DURING ITS FILLING

[75] Inventor: Bo Poulsen, Copenhagen, Denmark

[73] Assignee: AGA, A.B., Cleveland, Ohio

[21] Appl. No.: 428,905

[22] Filed: Sep. 30, 1982

[51] Int. Cl.[4] ..... B65B 1/20

[52] U.S. Cl. ..... 141/82; 141/11; 62/64

[58] Field of Search ..... 62/64; 222/146 C; 261/DIG. 9, 112; 141/1, 2, 11, 18, 69, 82, 392, 363–366, 89–92; 239/273, 567; 137/334; 220/85 F, 85 P, 401, 428

[56] References Cited

U.S. PATENT DOCUMENTS

| | | | |
|---|---|---|---|
| 2,075,408 | 3/1937 | Sholes | 62/1 |
| 2,498,401 | 2/1950 | Duncan | 141/82 X |
| 2,671,590 | 3/1954 | McBean et al. | 141/11 |
| 2,959,023 | 11/1960 | Webster | 62/64 |
| 3,659,428 | 5/1972 | Kunioka et al. | 62/64 |
| 4,010,623 | 3/1977 | Kaschak | 141/82 |

FOREIGN PATENT DOCUMENTS

| | | | |
|---|---|---|---|
| P264084 | 2/1913 | Fed. Rep. of Germany . | |
| 2640842 | 6/1980 | Fed. Rep. of Germany . | |
| 1417235 | 10/1965 | France | 141/4 |
| 2422901 | 11/1979 | France . | |
| 7212223 | 9/1972 | Sweden . | |
| 370272 | 10/1974 | Sweden . | |
| 2030972 | 2/1980 | United Kingdom | 141/1 |

*Primary Examiner*—Stephen Marcus
*Assistant Examiner*—Ernest G. Cusick
*Attorney, Agent, or Firm*—David A. Burge

[57] ABSTRACT

Lower portions of the outer wall of a pressurized gas cylinder are cooled during filling of the cylinder with a pressurized gas such as acetylene. A basket-like frame is installed atop the cylinder to support an annular manifold such that the manifold encircles the cylinder at a location spaced downwardly from the top of the cylinder. The manifold defines a plurality of fluid discharge openings which direct multiple flows of coolant toward the outer walls of the cylinder, whereby lower portions of the outer wall of the cylinder are bathed with a flowing curtain of coolant. The frame includes a C-shaped member which rests on the upper shoulders of the cylinder, and struts which depend from the C-shaped member to support the manifold.

12 Claims, 2 Drawing Figures

METHOD AND APPARATUS FOR COOLING SELECTED WALL PORTIONS OF A PRESSURIZED GAS CYLINDER DURING ITS FILLING

CROSS-REFERENCE TO PATENT APPLICATIONS

Reference is made to the following related, concurrently-filed applications, the disclosures of which are incorporated herein by reference:

FILLING OF ACETYLENE CYLINDERS, Ser. No. 429,490 filed Sept. 30, 1982 by Bo Poulsen, hereinafter referred to as the "Filling System Case;" and ENCODED PROTECTIVE CAP FOR A PRESSURIZED GAS CYLINDER, Ser. No. 428,683 filed Sept. 30, 1982 by Bo Poulsen, hereinafter referred to as the "Fixed Cap Case."

BACKGROUND OF THE INVENTION

1. Field of the Invention

The present invention relates generally to the filling of acetylene gas cylinders and, more particularly, to a novel and improved method of filling acetylene cylinders, and to a novel and improved apparatus for cooling selected wall portions of a pressurized gas cylinder as it is being filled with acetylene.

2. Prior Art

As is well known, acetylene gas is relatively unstable at high pressures and cannot be transported safely in such open-chambered cylinders as are used to transport other industrial gases. For safety reasons, acetylene is usually transported in elongate steel cylinders of a specialized type, each containing a porous mass within which a solvent for acetylene is absorbed. The porous mass normally fills the cylinder body, and typically comprises a very porous, concrete-like substance such as calcium metasilicate having an admixture of a suitable fibrous material, for example asbestos, to increase its mechanical strength. The solvent is typically acetone or N,N-dimethylformamide.

From the point of view of safety it is important that the porous mass which fills the body of an acetylene cylinder leave no large cavities within the body wherein acetylene gas can collect and be compressed, causing an explosive decomposition of acetylene to take place. Decomposition of acetylene into its elements can be prevented by minimizing the size of the spaces defined (1) within the porous mass, and (2) between the porous mass and the surrounding internal wall surfaces of the cylinder.

The filling of acetylene cylinders involves problems beyond those normally encountered in filling cylinders with gases other than acetylene. When an acetylene cylinder is returned from a customer, it contains an unknown quantity of residual acetylene gas, and an unknown quantity of solvent. The quantity of solvent remaining in the cylinder is almost always less than the desired nominal amount due to discharge of evaporated solvent from the cylinder as acetylene gas is used by the customer.

The only information which can be ascertained about a returned cylinder by physically inspecting it is whether or not the cylinder appears to be damaged, and such cylinder data as is stamped or otherwise inscribed on the outside of the cylinder or on a cap affixed to the cylinder. The cylinder data carried on the outside of an acetylene gas cylinder normally includes a cylinder type designation (which defines the cylinder's internal volume), and the cylinder's "tare weight," i.e., weight of the cylinder together with the weight of the porous mass and the weight of a proper nominal charge of acetone solvent. By weighing a returned cylinder, it is possible to determine the total weight of the cylinder and such solvent and residual gas as remain in the cylinder. By measuring the pressure of the contents of the cylinder, and by taking into account the temperature of the cylinder, the exact quantities of residual gas and solvent which are present in the cylinder can be calculated readily.

In a conventional acetylene cylinder filling process, each cylinder is first physically inspected for possible damage. The contents of the cylinder are then checked with reference to the cylinder's tare weight, pressure and temperature, to determine the quantities of solvent and gas which remain in the cylinder. A calculation is then made to determine the quantities of solvent and gas which should be supplied to refill the cylinder.

In accordance with conventional filling procedures, an acetylene cylinder which has been checked in the manner described above is refilled first by charging it with the requisite amount of missing solvent, and then by introducing the requisite quantities of acetylene gas. The gas is fed into the cylinder at a relatively low pressure during a period of time which extends for many hours. While cylinders are charged on an individual basis to supply them with the requisite quantities of solvent, a plurality of solvent-replenished cylinders are connected together or "ganged" for simulateous filling with acetylene.

While a cylinder is being filled with acetylene, the temperature of the cylinder is caused to rise due to the high heat of solution of acetylene. Stated in another way, as acetylene gas is dissolved by a cylinder-carried solvent such as acetone, a substantial amount of heat energy is released, causing a marked elevation in the temperature of the cylinder and its contents. As the temperature of the cylinder's contents rises, so too does the pressure within the cylinder. When the pressure within the ganged cylinders reaches approximately 25 bar (about 360 psia), filling is halted because, from a safety point of view, this is considered to be about the highest pressure to which acetylene should normally be compressed. The partially filled cylinders are then left standing to cool.

After a sufficient period of cooling time, the cylinders stabilize in temperature, and can then be further charged with acetylene to complete the filling procedure. The filled cylinders are then disconnected from the filling apparatus and individually weighed to make certain that they contain, within certain tolerances, the prescribed quantity of acetylene. Any cylinders showing excess weight are slightly emptied. Any cylinders which have been insufficiently filled are given an additional filling.

In temperate climates, about seven hours is a normal time for the initial filling of a solvent-charged cylinder with acetylene gas, followed by about a twelve hour pause for cooling, whereafter a final filling with acetylene usually requires about an additional two hours. In hotter climates these filling and cooling times are considerably longer.

In order to diminish filling time, it has been proposed to cool acetylene cylinders during filling by spraying their outer walls with a liquid coolant. The coolant is discharged onto the cylinders from overhead nozzles, and typically comprises either cold water, or a cold antifreeze solution such as a mixture of water and alcohol. The overhead arrangement of spray nozzles causes coolant to flow along the full lengths of the outer walls of the cylinders. Cooling the cylinders during filling not only serves to reduce cylinder filling time, but also enables larger numbers of cylinders to be processed through a filling station, and minimizes the need for extensive banks of filling equipment. Moreover, the cost of labor per filled cylinder is reduced.

Where cylinders being filled are cooled along their entire length, the temperature of the contents of the cylinder is substantially uniform, and acetylene tends to be disolved substantially uniformly throughout the cylinder by the acetone carried in the cylinder. From a safety standpoint, it is undesirable to have a high concentration of acetylene near an upper end region of the cylinder because, in the event that the upper end region of the cylinder is exposed to a sudden increase in pressure, as occurs in a "backfire situation," the high concentration of acetylene in the upper end region of the cylinder may begin to decompose. Stated in another way, the previously proposed approach of cooling cylinders along their full lengths during filling with acetylene does not provide an optimum type of cooling, from a safety point of view, for it tends to provide an unduly high concentration of acetylene in the upper end regions of cylinders being filled, and does nothing to discourage this undesireable condition.

3. The Referenced Applications

The referenced Filling System Case describes a particular cylinder filling situation wherein the present invention is preferably utilized.

The referenced Fixed Cap Case relates to an encoded cap for a cylinder. The system of the present invention may be used with cylinders which carry such caps.

SUMMARY OF THE INVENTION

The present invention overcomes the foregoing and other drawbacks of the prior art by providing a novel and improved method and apparatus for selectively cooling only lower portions of a pressurized gas cylinder during filling. Where the present invention is employed with acetylene cylinders, it provides a safer, controlled variation in acetlyene concentration along the length of a cylinder being filled.

In accordance with the preferred practice of the present invention, selected lower portions of the outer wall of a pressurized gas cylinder are cooled during filling of the cylinder. A basket-like frame is installed atop the cylinder to support an annular manifold such that the manifold encircles the cylinder at a location spaced downwardly from the top of the cylinder. The manifold defines a plurality of fluid discharge openings which direct multiple flows of coolant toward the outer walls of the cylinder, whereby lower portions of the outer wall of the cylinder are bathed with a flowing curtain of coolant. The basket-like frame includes a C-shaped member which rests on the upper shoulders of the cylinder, and struts which depend from the C-shaped member to support the manifold.

A feature of the present invention resides in the use of a cylinder cooling apparatus which sprays coolant selectively onto only lower portions of the outer wall of a cylinder being filled with acetylene. This arrangement assures that the upper end region of the cylinder remains substantially warmer than the lower portions. Where the invention is utilized with an acetylene cylinder, acetylene is caused to dissolve at a higher concentration toward the lower end of the cylinder. By keeping the upper end region of the cylinder relatively warm, the concentration of acetylene in the upper end region tends to be relatively low, whereby the safety of the cylinder is enhanced by rendering the cylinder more resistant to backfire.

Another feature of the present invention lies in the provision of an apparatus for efficiently dispensing coolant along selected outer wall portions of a pressurized gas cylinder.

Still another feature lies in the provision of a cylinder cooling system which can be utilized in conjunction with a computer-controlled filling system. Such a system is described in the referenced "Filling System Case."

BRIEF DESCRIPTION OF THE DRAWINGS

The foregoing and other features of the present invention will be better understood by referring to the description of the preferred embodiment and claims which follow, taken together with the accompanying drawings, wherein:

DESCRIPTION OF THE PREFERRED EMBODIMENT

Figure 1:
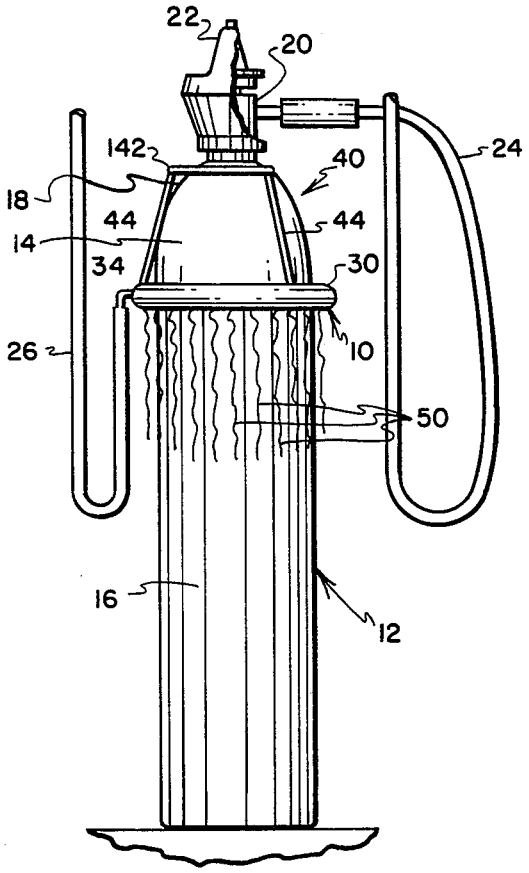
FIG. 1 is a side elevational view of a cooling apparatus embodying the preferred practice of the present invention shown installed on a pressurized gas cylinder which is in the process of being refilled; and, FIG. 2 is a perspective view, on an enlarged scale, of the cooling apparatus.
Figure 2:
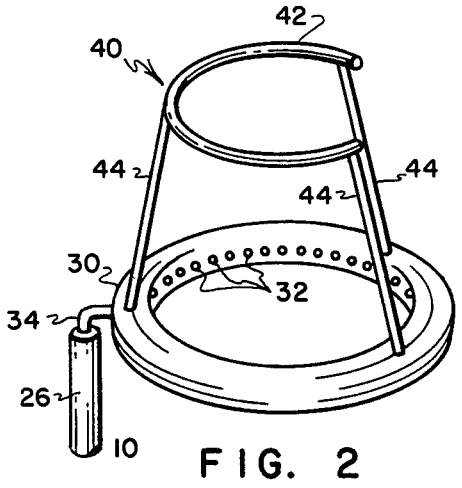

Referring to FIGS. 1 and 2, a cooling apparatus embodying the preferred practice of the present invention is indicated generally by the numeral 10. The cooling apparatus 10 is shown positioned atop a pressurized gas cylinder 12. The cylinder 12 has upper and lower outer wall portions 14, 16. The upper wall portion 14 includes a shoulder 18.

The cylinder 12 carries a valve 20. The valve 20 is protectively enclosed by a cap 22. The cap 22 preferably embodies features which are described in the referenced Fixed Cap Case.

In FIG. 1 the cylinder 12 is shown in the process of being filled with a pressurized gas, such as acetylene, through a filling line 24. The cylinder 12 is preferably filled through the use of a computer-controlled filling station of the type described in the referenced Filling System Case. The filling line 24 is connected to the valve 20 for introducing a flow of pressurized acetlyene gas into the cylinder 12. While the cylinder 12 is being filled with acetylene, the temperature of the cylinder 12 rises due to the heat of solution of acetlene which causes heat energy to be released as the gas is disolved in a solvent such as acetone. The cooling apparatus 10 is utilized to lower the temperature of lower outer wall portions 16 of the cylinder 12, and to maintain the lower outer wall portions 16 at a temperature below that of the upper wall portion 14.

The cooling apparatus 10 includes an annular manifold 30 supported by a basket-like frame 40. The frame 40 is installed atop the cylinder 12 and supports the annular manifold 30 at a position located about 200 mm (about 8 inches) below the shoulder 18 of the cylinder 12, where the manifold 30 encircles the cylinder 12.

The manifold 30 defines a plurality of spaced fluid discharge openings 32 which direct multiple flows of coolant 50 toward the lower outer wall portions 16. The manifold 30 carries an L-shaped connector 34 which communicates the manifold 30 with a flexible coolant supply hose 26. The L-shaped connector 34 extends outwardly and downwardly from the manifold 30, so that when connected, the weight of the hose 26 helps to hold the cooling apparatus 10 in position atop the cylinder 12.

Coolant is introduced through the hose 26 into the manifold 30 through the L-shaped connector 34. The coolant is then distributed by the manifold 30 to the fluid discharge openings 32 which, in turn, direct multiple flows of the coolant 50 in a curtain-like fashion down the lower outer wall portions 16 of the cylinder 12.

The basket-like frame 40 includes a C-shaped member 42 and a plurality of struts 44. The C-shaped member 42 rests atop the shoulder 18 of the cylinder 12. The struts 44 depend from the C-shaped member 42 and support the manifold 30.

By cooling only lower portions of the outer walls 16 of the cylinder 12 and maintaining these portions at a lower temperature than the upper portions 14 the acetylene tends to be dissolved by the cylinder-carried acetone in higher concentrations in the cooler lower portions 16 of the cylinder 12. By keeping the concentrations of acetylene low near the upper end 14 of the cylinder 12, the possibility of acetylene decomposing in the presence of a backfire situation is minimized.

While the term "cylinder" is used throughout this document in referring to such containers as are being filled or refilled with pressurized gas, it will be understood that this term is used simply to comply with the terminology used by those skilled in the art to which the present invention pertains. The term "cylinder" is not to be construed as being limiting, and applies with equal propriety to all forms of containers which are suitable for use with a particular pressurized gas.

Although the invention has been described in its preferred form with a certain degree of particularly, it is understood that the present disclosure of the preferred form has been made only by way example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentability exist in the invention disclosed.

What is claimed is:

1. An apparatus for differentially cooling wall portions of the outer wall of an elongated upstanding acetylene gas cylinder of the type having an upper end region that carries a cylinder filling connection and said cylinder therebeneath having an outer wall defining the acetylene gas chamber within the cylinder, comprising:

coolant dispensing means mounted in circumambient relation to said cylinder for dispensing coolant onto selected lower portions of said outer wall for cooling said selected wall portions during filling of the cylinder with acetylene, said selected lower wall portions of said cylinder being in spaced relation downwardly from said cylinder filling connection, said cylinder including upper wall portions of substantial axial extent surrounding a portion of said acetylene gas chamber which are disposed between said cylinder filling connection and said selected lower portions of said outer wall, and support means cooperatively associated with said cylinder for positioning said coolant dispensing means in proximity to said selected lower portions of said cylinder outer wall thereby to direct a flow of coolant across said selected outer wall lower portions while said upper portions remain free of coolant flow thereover, whereby the concentration of acetylene is relatively lower within said upper wall portions of said cylinder as compared with its concentration within said lower wall portions.

2. The apparatus of claim 1 wherein the dispensing means has a manifold with a plurality of spaced fluid discharge openings which direct the flow of coolant substantially radially inwardly with respect to the manifold.

3. The apparatus of claim 2 wherein:

(a) the apparatus includes a coolant supply line; and, (b) the manifold includes a connector which extends radially outwardly and downwardly with respect to the manifold for connection to the coolant supply line, such that the weight of at least a portion of the coolant supply line assists in maintaining the manifold in position on the cylinder.

4. The apparatus of claim 1 wherein the support means positions the dispensing means at a location spaced about 20 mm downwardly from the upper end region of the cylinder.

5. An apparatus for cooling an upstanding acetylene gas cylinder during filling, wherein the cylinder is of the type having an upper shoulder portion located atop outer wall portions, the apparatus comprising:

(a) coolant dispensing means including a manifold for dispensing coolant to selected parts of the outer wall portions;

(b) support means for positioning the dispensing means in proximity to the selected outer wall portions of the cylinder to direct a flow of coolant across the selected outer wall portions; and (c) the support means including:

(i) a support structure which rests on the upper shoulder portion of the cylinder; and, (ii) at least one strut which depends from the support structure to support the manifold.

6. The apparatus of claim 5 wherein the support structure is substantially C-shaped.

7. The apparatus of claim 5 wherein the support means includes a plurality of struts which depend from the support structure and connect with the manifold to support the manifold at a position spaced downwardly with respect to the shoulder portion of the cylinder.

8. A method of dissolving acetylene in a non-uniform concentration pattern to enhance safety and explosion prevention within a pressurized gas cylinder being filled with acetylene at a filling location on said cylinder, comprising the step of differentially cooling spaced first and second outer wall portions of the cylinder such that the first portion is maintained at a temperature below the temperature of the second portion, and wherein said second outer wall portion is proximate to said cylinder filling location, and said first outer wall portion is spaced therefrom.

9. The method of claim 8 wherein the step of differentially cooling outer wall portions includes the steps of:

(a) positioning a coolant dispenser in proximity to the first wall portion;

(b) supplying a flow of coolant to the dispenser during filling of the gas cylinder with pressurized gas; and, (c) dispensing coolant from the dispenser in directions substantially toward the first wall portion.

10. The method of claim 9 wherein:

(a) the gas cylinder is positioned in an upstanding attitude;

(b) the first wall portion comprises a lower part of the outer wall of the cylinder; and, (c) the step of dispensing coolant includes the step of directing the flow of coolant toward the lower part of the outer wall.

11. A method of differentially cooling a pressurized gas during filling thereof into a cylinder through a filling connection wherein said gas has undesirable and unstable characteristics under relatively higher pressures in said cylinders, and wherein it is desired to obtain differing relative concentrations to said gas in said cylinder for safety purposes comprising the steps of:

positioning a ring-like coolant dispenser about selected lower portions of an outer wall of the cylinder at a location spaced downwardly from the filing connection thereof and downwardly from portions of said outer wall thereabove, supplying a flow of coolant to the dispenser during the filling of the cylinder with said pressurized gas, and dispensing coolant from the dispenser onto said selected lower portions of the cylinder outer wall while avoiding dispensing coolant onto the upper portions of said outer wall above the coolant dispenser thereby to cool the lower portions of the cylinder outer wall and the gas therewithin relative to the gas within said cylinder at the upper outer wall portions thereof, whereby said gas will have differing concentrations in said cylinder above and below said dispenser with greater gas concentration in said cylinder below said coolant dispenser as compared with gas concentration in said cylinder above said dispenser.

12. The method of claim 11 wherein the step of positioning the dispenser includes the steps of providing the dispenser with support structure configured to engage the upper end portion of the cylinder, and of positioning the dispenser about the cylinder with the support structure in engagement with the upper end portion of the cylinder.

* * * * *